US008686906B2

(12) United States Patent
White et al.

(10) Patent No.: US 8,686,906 B2
(45) Date of Patent: Apr. 1, 2014

(54) MICROWAVE ANTENNA ASSEMBLIES

(75) Inventors: Carson R. White, Calabasas, CA (US); Hyok Jae Song, Agoura Hills, CA (US); Eray Yasan, Canton, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 276 days.

(21) Appl. No.: 12/886,310

(22) Filed: Sep. 20, 2010

(65) Prior Publication Data

US 2012/0068896 A1 Mar. 22, 2012

(51) Int. Cl.
*H01Q 1/32* (2006.01)

(52) U.S. Cl.
USPC ..... 343/713; 343/700 MS; 343/711; 343/846

(58) Field of Classification Search
USPC ..... 343/713
See application file for complete search history.

(56) References Cited

U.S. PATENT DOCUMENTS

| | | | | |
|---|---|---|---|---|
| 5,124,713 | A | 6/1992 | Mayes et al. | |
| 5,543,386 | A | 8/1996 | Findikoglu et al. | |
| 5,631,446 | A | 5/1997 | Quan | |
| 5,689,216 | A | 11/1997 | Sturdivant | |
| 5,973,648 | A | 10/1999 | Lindenmeier et al. | |
| 6,032,054 | A | 2/2000 | Schwinke | |
| 6,211,831 | B1 | 4/2001 | Nagy et al. | |
| 6,219,002 | B1 | 4/2001 | Lim | |
| 6,366,249 | B1 | 4/2002 | Jones et al. | |
| 6,417,747 | B1 | 7/2002 | Dearden et al. | |
| 6,424,300 | B1 | 7/2002 | Sanford et al. | |
| 6,617,943 | B1 | 9/2003 | Fazelpour | |
| 6,728,113 | B1 | 4/2004 | Knight et al. | |
| 6,765,574 | B1 | 7/2004 | Mao et al. | |
| 6,795,741 | B2 | 9/2004 | Simon | |
| 6,847,276 | B2 | 1/2005 | Tamaki et al. | |
| 6,853,337 | B2 | 2/2005 | Barabash | |
| 6,861,991 | B2 | 3/2005 | Mueller et al. | |
| 7,015,860 | B2 | 3/2006 | Alsliety | |
| 7,053,845 | B1 | 5/2006 | Holloway et al. | |
| 7,079,082 | B2 | 7/2006 | Iskander et al. | |
| 7,233,296 | B2 * | 6/2007 | Song et al. | 343/713 |
| 7,342,547 | B2 * | 3/2008 | Maniwa et al. | 343/713 |
| 7,427,961 | B2 | 9/2008 | Song et al. | |
| 7,710,325 | B2 | 5/2010 | Cheng | |
| 8,098,205 | B2 | 1/2012 | Rabinovich et al. | |
| 2003/0103010 | A1 | 6/2003 | Boyle | |
| 2005/0219136 | A1 | 10/2005 | Iskander et al. | |
| 2008/0042903 | A1 | 2/2008 | Cheng | |

(Continued)

OTHER PUBLICATIONS

Robert A. Sainati, CAD of Microstrip for Wireless Applications, ISBN 0-89006-562-4, 1996, pp. 29-30 and 92-94.*

(Continued)

*Primary Examiner* — Jerome Jackson, Jr.
*Assistant Examiner* — Hai Tran
(74) *Attorney, Agent, or Firm* — Ingrassia Fisher & Lorenz, P.C.

(57) ABSTRACT

A microwave antenna assembly includes a first dielectric layer, a second dielectric layer, a conductive layer, a first conductive patch, and a second conductive patch. The conductive layer is disposed in an inner region between the first dielectric layer and the second dielectric layer. The conductive layer includes a slot. A first conductive patch is surrounded by the slot. The second conductive patch is disposed against the second dielectric layer outside the inner region, and is electromagnetically coupled to the first conductive patch.

17 Claims, 6 Drawing Sheets

(56) References Cited

U.S. PATENT DOCUMENTS

| | | | |
|---|---|---|---|
| 2009/0009399 | A1 | 1/2009 | Gaucher et al. |
| 2009/0289852 | A1 | 11/2009 | Li et al. |
| 2010/0164790 | A1 | 7/2010 | Wisnewski et al. |
| 2011/0018656 | A1 | 1/2011 | Lee et al. |
| 2011/0037656 | A1 | 2/2011 | Bremner et al. |

OTHER PUBLICATIONS

Ellis, T.J., et al. "A wideband CPW-to-microstrip transition for millimeter-wave packaging," IEEE MTT-S International Microwave Symposium Digest, 1999, pp. 629-632, vol. 2.
Lin, T.-H. "Via-free broadband microstrip to CPW transition," IEEE Electronic Letters, Jul. 19, 2001, pp. 960-961, vol. 37, No. 15.
Houdart, M., et al. "Various Excitation of Coplanar Waveguide," IEEE MTT-S International Microwave Symposium Digest, Apr. 1979, pp. 116-118, vol. 79, No. 1.
Hopf, J. F. et al. "Compact Multi-antenna System for Cars with Electrically Invisible Phone Antennas for SDARS Frequencies," 2nd International ITG Conference on Antennas, Mar. 2007, pp. 171-175.
Chiu, C-Y., et al. "Reduction of Mutual Coupling Between Closely-Packed Antenna Elements," IEEE Transactions on Antennas and Propagation, Jun. 2007, pp. 1732-1738, vol. 55, No. 6.
Andersen, J., et al. "Decoupling and Descattering Networks for Antennas," IEEE Transactions on Antennas and Propagation, Nov. 1976, pp. 841-846, vol. 24, No. 6.
White, C. R., et al. Connector Assembly and Method of Assembling a Connector Arrangement Utilizing the Connector Assembly, U.S. Appl. No. 12/622,683, filed Nov. 20, 2009.
Final Office Action, dated May 10, 2012, for U.S. Appl. 12/622,683.
Response to Final Office Action, dated Jun. 29, 2012, for U.S. Appl. 12/622,683.
Notice of Allowance, dated Jul. 18, 2012, for U.S. Appl. 12/622,683.
Response to Office Action, dated Mar. 13, 2012, for U.S. Appl. 12/622,683.
Song, H.J., et al. "Antenna System and Filter," U. S. Appl. No. 12/886,322, filed Sep. 20, 2010.
Song, H.J., et al. "Multi-Function Antenna," U.S. Appl. No. 12/952,992, filed Nov. 23, 2010.
Waterhouse, R.B., et al. "Small Folded CPW Fed Slot Antennas," IEEE Antennas and Propagation Society International Symposium, Jul. 2006, pp. 2599-2602.
Jan, J.-Y., et al. "Wideband CPW-fed Slot Antenna for DCS, PCS, 3G and Bluetooth Bands," IEEE Electronics Letters, Nov. 23, 2006, pp. 1377-1378, vol. 42, No. 24.
SZE, J.-Y., et al., "Circularly Polarized Square Slot Antenna With a Pair of Inverterd-L Grounded Strips," IEEE Antennas and Wireless Propagation Letters, 2008, pp. 149-151, vol. 7.
Bao, X., et al., "Dual-Frequency Dual-Sense Circularly-Polarized Slot Antenna Fed by Microstrip Line," IEEE Transactions on Antennas and Propagation, Mar. 2008, pp. 645-649, vol. 56, No. 3.
Chen, C., et al., "Dual-band dual-sense circularly-polarized CPW-fed slot antenna with two spiral slots loaded," IEEE Transactions on Antennas and Propagation, Jun. 2009, pp. 1829-1833, vol. 57, No. 6.
U.S. Office Action, dated Dec. 13, 2011, for U.S. Appl. No. 12/622,683.
Office Action, dated Nov. 6, 2012, for U.S. Appl. No. 121886,322.
Notice of Allowance, dated Sep. 13, 2012, for U.S. Appl. No. 12/622,683.
USPTO, Office Action in U.S. Appl. No. 12/952,992, mailed Feb. 14, 2013.
USPTO, Office Action for U.S. Appl. No. 12/952,992, mailed Aug. 6, 2013.
USPTO, Notice of Allowance for U.S. Appl. No. 12/952,992, mailed Nov. 15, 2013.

* cited by examiner

MICROWAVE ANTENNA ASSEMBLIES

TECHNICAL FIELD

The technical field generally relates to antennas, and, more particularly, to microwave antenna assemblies, for example for use in windshields of vehicles.

BACKGROUND

Microwave antennas are utilized in various vehicles, among other applications. When used for vehicles, microwave antennas are typically mounted on a roof of the vehicle and radiate outward from the vehicle. It may be desirable to place a microwave antenna in other locations of the vehicle. However, conventional microwave antennas may produce radiation in unwanted directions, for example into the vehicle, if placed elsewhere within the vehicle. For example, a conventional microwave antenna assembly disposed in a front windshield of the vehicle may produce unwanted radiation toward the interior of the vehicle. While there are known antenna geometries that produce single sided radiation, realizing such antennas would require cutting precise holes, for example in a windshield of a vehicle, which may be undesirable.

Accordingly, it is desirable to provide an improved microwave antenna assembly, for example with reduced radiation toward one side relative to another side. Furthermore, other desirable features and characteristics of the present invention will become apparent from the subsequent detailed description and the appended claims, taken in conjunction with the accompanying drawings and the foregoing technical field and background.

SUMMARY

In accordance with one example, a microwave antenna assembly is provided. The microwave antenna assembly comprises a first dielectric layer, a second dielectric layer, a conductive layer, a first conductive patch, and a second conductive patch. The conductive layer is disposed in an inner region between the first dielectric layer and the second dielectric layer. The conductive layer includes a slot. The first conductive patch is surrounded by the slot. The second conductive patch is disposed against the second dielectric layer outside the inner region, and is electromagnetically coupled to the first conductive patch.

In accordance with another example, a microwave antenna assembly is provided. The microwave antenna assembly comprises a first glass layer, a second glass layer, a transparent conductive layer, and a circuit board. The transparent conductive layer is disposed between the first and second glass layers. The conductive layer includes a slot. A conductive patch is surrounded by the slot. The circuit board is disposed against the second glass layer. The second glass layer is disposed between the conductive patch and the circuit board, and the circuit board is electromagnetically coupled to the conductive patch.

In accordance with a further example, a microwave antenna assembly for a vehicle is provided. The microwave antenna assembly comprises a windshield of the vehicle, a transparent conductive layer, and a circuit board. The transparent conductive layer is disposed within the windshield. The transparent conductive layer includes a slot. A first conductive patch is surrounded by the slot. The first conductive patch has a first length and a first width. The circuit board is disposed against the windshield, and comprises a second conductive patch. The second conductive patch is electromagnetically coupled to the first conductive patch.

BRIEF DESCRIPTION OF THE DRAWINGS

Certain examples of the present disclosure will hereinafter be described in conjunction with the following drawing figures, wherein like numerals denote like elements, and wherein.

DETAILED DESCRIPTION

The following detailed description is merely exemplary in nature, and is not intended to limit the disclosure or the application and uses thereof. Furthermore, there is no intention to be bound by any expressed or implied theory presented in the preceding technical field, background, or the following detailed description.

Figure 1:
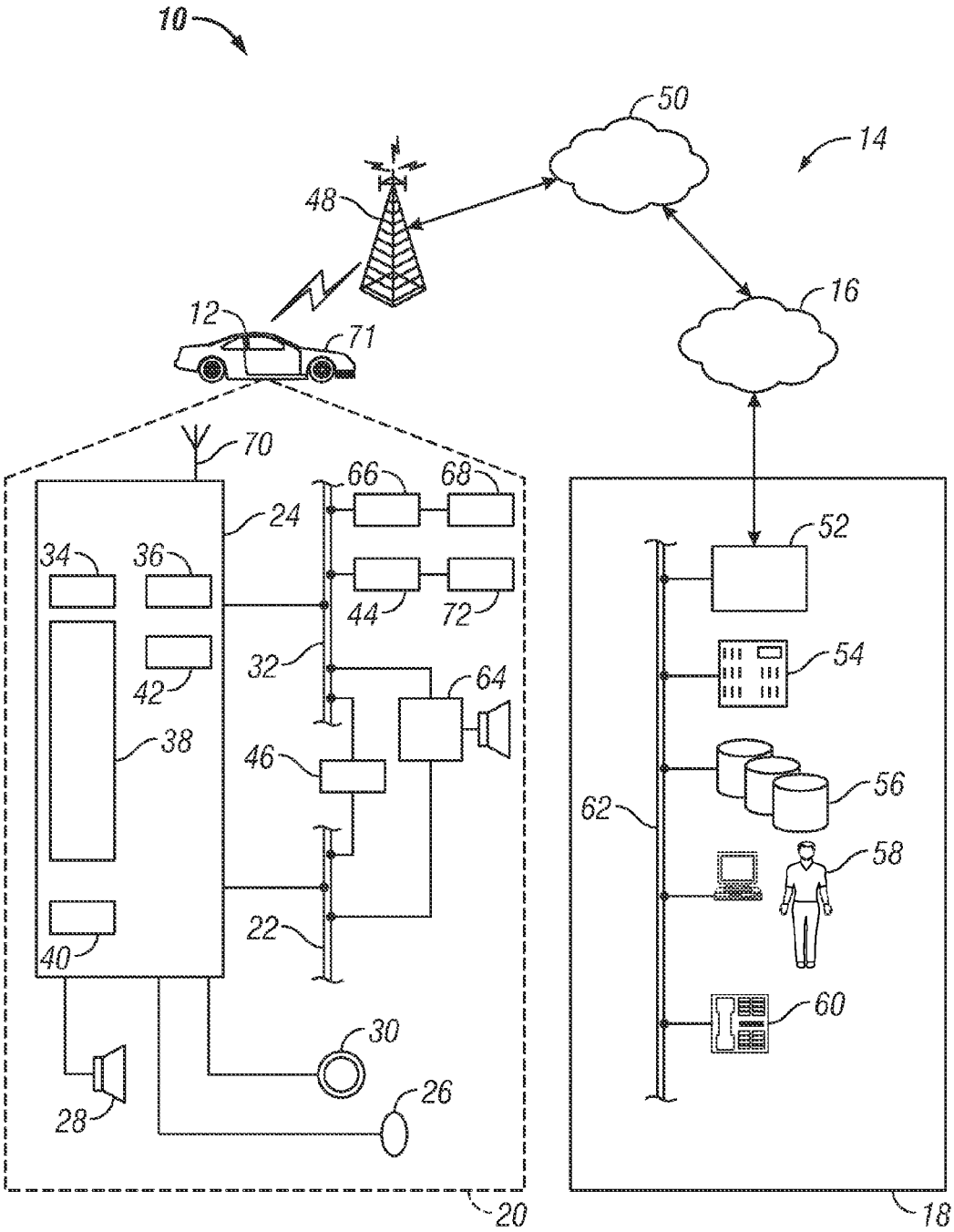
FIG. 1 is a schematic illustration of a non-limiting example of a communication system, including a telematics unit, for a vehicle.

With reference to FIG. 1, there is shown a non-limiting example of a communication system 10 that may be used together with examples of the systems disclosed herein. The communication system generally includes a vehicle 12, a wireless carrier system 14, a land network 16 and a call center 18. It should be appreciated that the overall architecture, setup and operation, as well as the individual components of the illustrated system are merely exemplary and that differently configured communication systems may also be utilized to implement the examples of the method disclosed herein. Thus, the following paragraphs, which provide a brief overview of the illustrated communication system 10, are not intended to be limiting.

Vehicle 12 may be any type of mobile vehicle such as a motorcycle, car, truck, recreational vehicle (RV), boat, plane, and the like, and is equipped with suitable hardware and software that enables it to communicate over communication system 10. Some of the vehicle hardware 20 is shown generally in FIG. 1 including a telematics unit 24, a microphone 26, a speaker 28, and buttons and/or controls 30 connected to the telematics unit 24. Operatively coupled to the telematics unit 24 is a network connection or vehicle bus 32. Examples of suitable network connections include a controller area network (CAN), a media oriented system transfer (MOST), a local interconnection network (LIN), an Ethernet, and other appropriate connections such as those that conform with known ISO (International Organization for Standardization), SAE (Society of Automotive Engineers), and/or IEEE (Institute of Electrical and Electronics Engineers) standards and specifications, to name a few.

The telematics unit 24 is an onboard device that provides a variety of services through its communication with the call center 18, and generally includes an electronic processing device 38, one or more types of electronic memory 40, a cellular chipset/component 34, a wireless modem 36, a dual mode antenna 70, and a navigation unit containing a GPS chipset/component 42. In one example, the wireless modem 36 includes a computer program and/or set of software routines adapted to be executed within the electronic processing device 38. The dual mode antenna 70 is preferably disposed within a windshield 71 of the vehicle 12. In addition, the dual mode antenna 70 preferably comprises and/or is implemented in connection with a microwave antenna assembly, for example as depicted in FIGS. 2-6 and described further below in connection therewith.

The telematics unit 24 may provide various services including: turn-by-turn directions and other navigation-related services provided in conjunction with the GPS chipset/component 42; airbag deployment notification and other emergency or roadside assistance-related services provided in connection with various crash and/or collision sensor interface modules 66 and collision sensors 68 located throughout the vehicle; and/or infotainment-related services where music, internet web pages, movies, television programs, videogames, and/or other content are downloaded by an infotainment center 46 operatively connected to the telematics unit 24 via vehicle bus 32 and audio bus 22. In one example, downloaded content is stored for current or later playback. The above-listed services are by no means an exhaustive list of all the capabilities of telematics unit 24, but are simply an illustration of some of the services that the telematics unit may be capable of offering. It is anticipated that telematics unit 24 may include a number of additional components in addition to and/or different components from those listed above. The telematics unit 24 comprises and/or is implemented in connection with a microwave antenna assembly, for example as depicted in FIGS. 2-6 and described further below in connection therewith.

Vehicle communications may use radio transmissions to establish a voice channel with wireless carrier system 14 so that both voice and data transmissions can be sent and received over the voice channel. Vehicle communications are enabled via the cellular chipset/component 34 for voice communications and the wireless modem 36 for data transmission. In order to enable successful data transmission over the voice channel, wireless modem 36 applies some type of encoding or modulation to convert the digital data so that it can be communicated through a vocoder or speech codec incorporated in the cellular chipset/component 34. Any suitable encoding or modulation technique that provides an acceptable data rate and bit error can be used with the present examples. Dual mode antenna 70 services the GPS chipset/component 42 and the cellular chipset/component 34.

Microphone 26 provides the driver or other vehicle occupant with a means for inputting verbal or other auditory commands, and can be equipped with an embedded voice processing unit utilizing a human/machine interface (HMI) technology known in the art. Conversely, speaker 28 provides audible output to the vehicle occupants and can be either a stand-alone speaker specifically dedicated for use with the telematics unit 24 or can be part of a vehicle audio component 64. In either event, microphone 26 and speaker 28 enable vehicle hardware 20 and call center 18 to communicate with the occupants through audible speech. The vehicle hardware also includes one or more buttons and/or controls 30 for enabling a vehicle occupant to activate or engage one or more of the vehicle hardware 20 components. For example, one of the buttons and/or controls 30 can be an electronic pushbutton used to initiate voice communication with call center 18 (whether it be a human such as advisor 58 or an automated call response system). In another example, one of the buttons and/or controls 30 can be used to initiate emergency services.

The audio component 64 is operatively connected to the vehicle bus 32 and the audio bus 22. The audio component 64 receives analog information, rendering it as sound, via the audio bus 22. Digital information is received via the vehicle bus 32. The audio component 64 provides amplitude modulated (AM) and frequency modulated (FM) radio, compact disc (CD), digital video disc (DVD), and multimedia functionality independent of the infotainment center 46. Audio component 64 may contain a speaker system, or may utilize speaker 28 via arbitration on vehicle bus 32 and/or audio bus 22.

The vehicle crash and/or collision detection sensor interface 66 is operatively connected to the vehicle bus 32. The collision sensors 68 provide information to the telematics unit via the crash and/or collision detection sensor interface 66 regarding the severity of a vehicle collision, such as the angle of impact and the amount of force sustained.

Vehicle sensors 72, connected to various sensor interface modules 44 are operatively connected to the vehicle bus 32. Exemplary vehicle sensors include but are not limited to gyroscopes, accelerometers, magnetometers, emission detection, and/or control sensors, and the like. Exemplary sensor interface modules 44 include powertrain control, climate control, and body control, to name but a few.

Wireless carrier system 14 may be a cellular telephone system or any other suitable wireless system that transmits signals between the vehicle hardware 20 and land network 16. According to an example, wireless carrier system 14 includes one or more cell towers 48, base stations and/or mobile switching centers (MSCs) 50, as well as any other networking components required to connect the wireless carrier system 14 with land network 16. As appreciated by those skilled in the art, various cell tower/base station/MSC arrangements are possible and could be used with wireless carrier system 14. For example, a base station and a cell tower could be co-located at the same site or they could be remotely located, and a single base station could be coupled to various cell towers or various base stations could be coupled with a single MSC, to list but a few of the possible arrangements. A speech codec or vocoder may be incorporated in one or more of the base stations, but depending on the particular architecture of the wireless network, it could be incorporated within a Mobile Switching Center or some other network components as well.

Land network 16 can comprise a conventional land-based telecommunications network that is connected to one or more landline telephones, and that connects wireless carrier system 14 to call center 18. For example, land network 16 can include a public switched telephone network (PSTN) and/or an Internet protocol (IP) network, as is appreciated by those skilled in the art. Of course, one or more segments of the land network 16 can be implemented in the form of a standard wired network, a fiber or other optical network, a cable network, other wireless networks such as wireless local networks (WLANs) or networks providing broadband wireless access (BWA), or any combination thereof.

Call center 18 is designed to provide the vehicle hardware 20 with a number of different system back-end functions and, according to the example shown here, generally includes one or more switches 52, servers 54, databases 56, advisors 58, as well as a variety of other telecommunication/computer equipment 60. These various call center components are suitably coupled to one another via a network connection or bus 62, such as the one previously described in connection with the vehicle hardware 20. Switch 52, which can be a private branch exchange (PBX) switch, routes incoming signals so that voice transmissions are usually sent to either the live advisor 58 or an automated response system, and data transmissions are passed on to a modem or other piece of telecommunication/computer equipment 60 for demodulation and further signal processing. The modem or other telecommunication/computer equipment 60 may include an encoder, as previously explained, and can be connected to various devices such as a server 54 and database 56. For example, database 56 could be designed to store subscriber profile records, subscriber behavioral patterns, or any other pertinent subscriber information. Although the illustrated example has been described as it would be used in conjunction with a manned call center 18, it will be appreciated that the call center 18 can be any central or remote facility, manned or unmanned, mobile or fixed, to or from which it is desirable to exchange voice and data.

Figure 2:
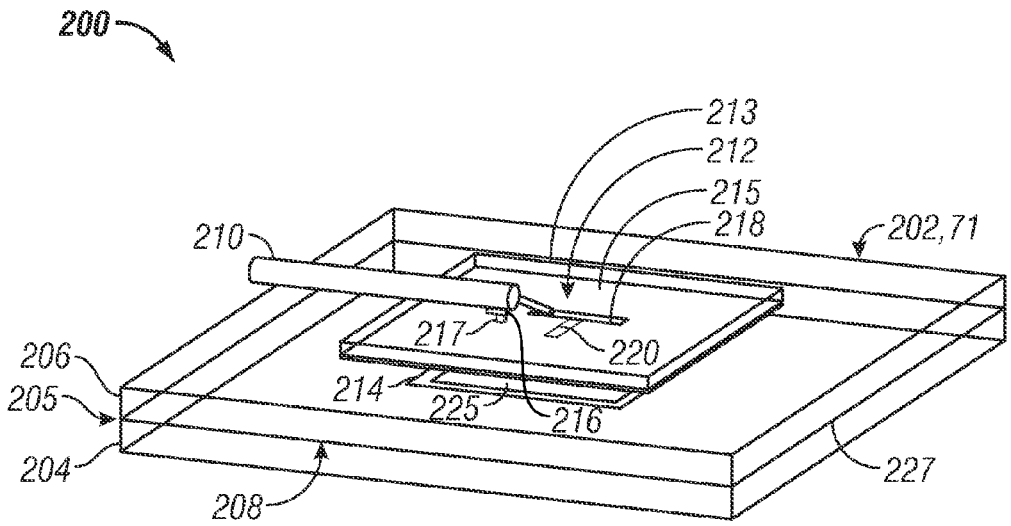
FIG. 2 is a schematic illustration of a non-limiting example of a microwave antenna assembly, that can be installed in a windshield of and/or otherwise used in connection with the communication system, the vehicle, and the telematics unit of FIG. 1.
Figure 3:
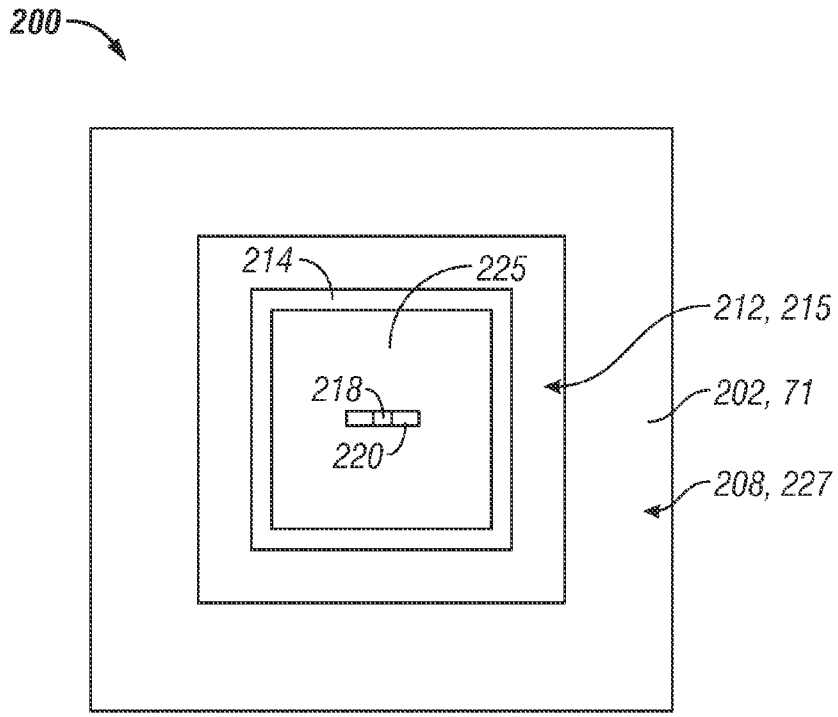
FIG. 3 is a schematic illustration of the microwave antenna assembly of FIG. 2, shown from a top view.
Figure 4:
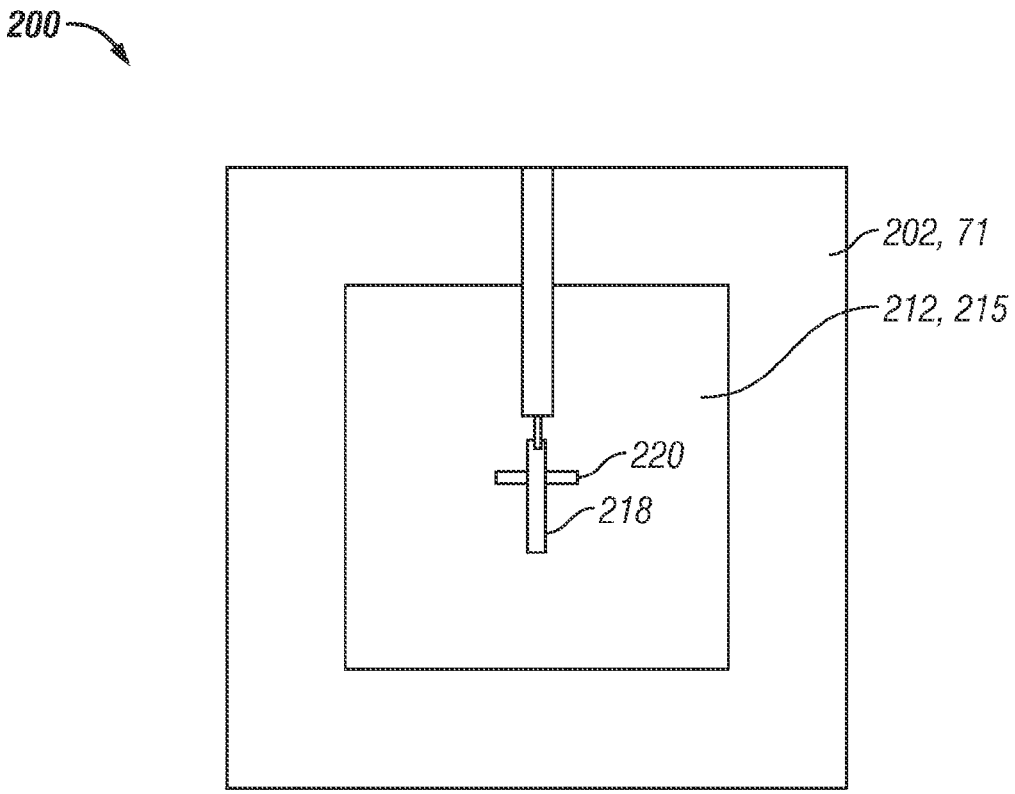
FIG. 4 is a schematic illustration of the microwave antenna assembly of FIG. 2, shown from a bottom view.
Figure 5:
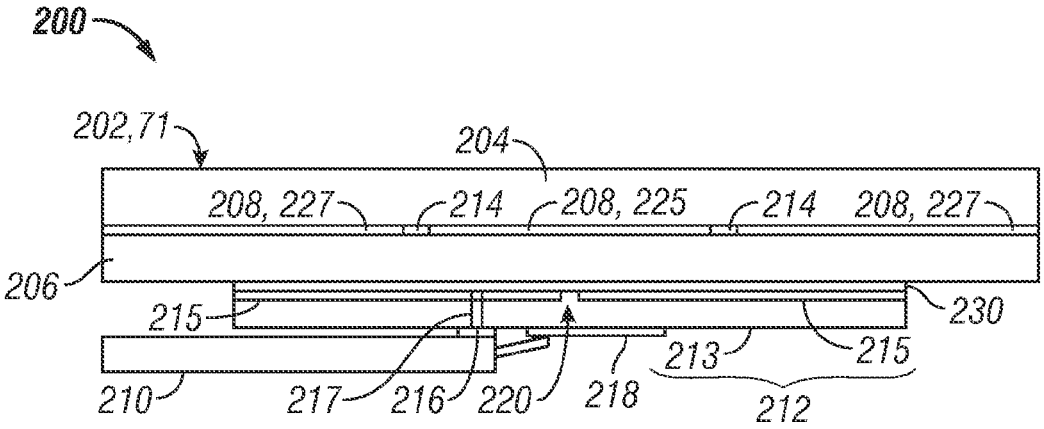
FIG. 5 is a cross-sectional illustration of the microwave antenna assembly of FIG. 2.
Figure 6:
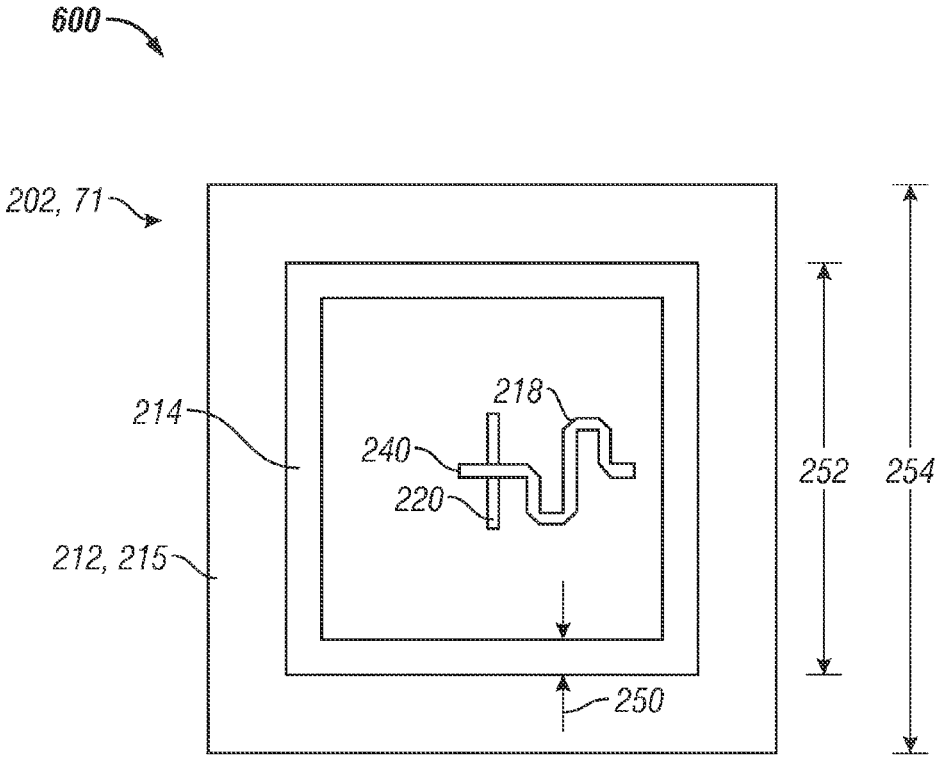
FIG. 6 is an illustration of a microwave antenna assembly with features of the microwave assembly of FIG. 2, but with a different, specific geometry.

FIGS. 2-6 provide illustrations of a non-limiting example of a microwave antenna assembly 200. Specifically, FIG. 2 is a schematic illustration of the microwave antenna assembly 200; FIG. 3 is an illustration of the microwave antenna assembly 200 from a top view; FIG. 4 is an illustration of the microwave antenna assembly 200 from a bottom view; FIG. 5 is a cross-sectional illustration of the microwave antenna assembly 200; and FIG. 6 is an illustration of a microwave antenna assembly 600 with features of the microwave assembly of FIG. 2, but with a different, specific geometry.

The microwave antenna assembly 200 is a virtual-cavity-backed patch antenna, preferably for integration into a front windshield of an automobile or another type of vehicle with an embedded conductive layer. In one example, the microwave antenna assembly 200 has an intended frequency range of 1574-1576 MHz, and corresponds to a global positioning system (GPS) band. In other examples, the center frequency may be in the range of 800 MHz to 10 GHz. The microwave antenna assembly 200 can be installed within and/or otherwise used in connection with the communication system 10, the vehicle 12, and the telematics unit 24 of FIG. 1.

As depicted in FIGS. 2-6, the microwave antenna assembly 200 includes a first dielectric layer 204, a second dielectric layer 206, a conductive layer 208, a coaxial cable 210, and a circuit board 212. The first dielectric layer 204 and a second dielectric layer 206 each having respective inner and outer surfaces (not depicted), and may collectively form a housing 202. The first and second dielectric layers 204, 206 define an inner region 205 therebetween. The first and second dielectric layers 204, 206 each preferably comprise glass. Whereas current window-glass-integrated antennas have double sided radiation, the microwave antenna assembly 200 has single-sided radiation, preferably directed in an outer direction away from the interior of the vehicle.

In one preferred example, the housing 202 comprises the windshield 71 of the vehicle 12 of FIG. 1, such as a solar-reflective windshield. For example, as defined herein with respect to this non-limiting example, the inner surface of the first dielectric layer 204 faces and is relatively closer to an interior of the vehicle, and an outer surface of the first dielectric layer 204 faces and is relatively closer (as compared with the inner surface of the first dielectric layer 204) to an exterior of the vehicle. Conversely, the outer surface of the second dielectric layer 206 faces and is relatively closer (as compared with an inner surface of the second dielectric layer 206) to an interior of the vehicle, and the inner surface of the second dielectric layer 206 faces the first dielectric layer 204.

The conductive layer 208 is disposed between the first and second dielectric layers. Specifically, the conductive layer 208 is disposed between the inner surface of the first dielectric layer 204 and the inner surface of the second dielectric layer 206. The conductive layer 208 preferably comprises a thin film of a transparent conductive material. In one preferred example, the conductive layer 208 is less than 0.1 mm in thickness. In one example, the conductive layer 208 comprises indium tin oxide (ITO). In another example, the conductive layer 208 comprises a silver-based conductive film. In yet other examples, the conductive layer 208 comprises one or more other conductive materials.

The conductive layer 208 includes a slot ring 214 formed therein through at least a portion of the conductive layer 208. Preferably, the slot ring 214 comprises a complete exclusion of a form (as depicted, a square ring) from the conductive layer 208. The slot ring 214 forms a coplanar conductive layer patch 225 and ground plane 227 in the conductive layer 208. Specifically, the slot ring 214 surrounds and defines the conductive layer patch 225. The slot ring 214 extends through the entire depth of a portion of the conductive layer 208. In the depicted example, the slot ring 214 is square in shape. However, this may vary in other examples. Regardless of the shape of the slot ring 214, the conductive layer patch 225 is preferably formed by a portion of the conductive layer 208 within, and surrounded by, the perimeter of the slot ring 214.

The circuit board 212 preferably comprises a printed circuit board (PCB), and electromagnetically couples the coaxial cable 210 and the conductive layer 208. Specifically, the circuit board 212 electromagnetically couples the coaxial cable 210 and the conductive layer patch 225. The circuit board 212 is disposed against the second dielectric layer 206, outside the inner region 205. Preferably, with reference to the above-described example in which the first and second dielectric layers 204, 206 are part of a windshield 71 of FIG. 1, the circuit board 212 is preferably disposed against the outer surface of the second dielectric layer 206. Accordingly, the circuit board 212 is preferably disposed outside and against the housing 202, opposing the conductive layer 208 that is disposed inside the housing 202.

In this example, the circuit board 212 is attached to the bottom surface of the windshield (e.g., the outer surface of the second dielectric layer 206, closest to the inside of the vehicle) in proper orientation with respect to the conductive layer patch 225 via a dielectric adhesive 230. The dielectric adhesive 230 is preferably dielectric and non-conductive, and has sufficient mechanical strength to hold the circuit board 212 in place against the second dielectric layer 206. In one example, the dielectric adhesive 230 comprises a product sold under the trademark 467 MP manufactured by the 3M Corporation. However, this may vary in other examples.

The circuit board 212 includes an electrically conductive patch 215, a microstrip line with open-circuited stub 218, and a slot 220 cut out of electrically conductive patch 215. Specifically, the top surface of the circuit board 212 includes the electrically conductive patch 215 (hereafter referred to as the PCB patch). The PCB patch 215 is preferably slightly larger than the outer dimension of the slot ring 214 and the conductive layer patch 225, and faces the conductive layer patch 225. The PCB patch 215 is electromagnetically coupled to the conductive layer patch 225. The PCB patch 215 preferably comprises a conductive layer or ground plane for the circuit board 212, and serves as a cavity backing for the microwave antenna assembly 200. In one example, the PCB patch comprises copper or a copper alloy. In other examples, the PCB patch 215 may comprise other conductive materials.

The microstrip line 218 comprises a conductive strip disposed opposite from the PCB patch 215. In the depicted example, the microstrip line 218 is disposed in a direction that is substantially parallel to the coaxial cable 210. However, this may vary. The slot 220 comprises an aperture formed within the conductive layer patch 225. The microstrip line 218 and the slot 220 preferably form an aperture-coupled microstrip feed that electromagnetically couples the PCB patch 215 to the conductive layer patch 225, and that facilitates the delivery of electromagnetic energy from the coaxial cable 210 to the conductive layer patch 225.

The antenna is preferably fed by aperture coupling to the microstrip line 218 on the bottom side of the circuit board 212. The slot 220 (or aperture) is preferably cut in the PCB patch 215, and an open-circuited microstrip stub 218 crosses the slot 220. The PCB patch 215 serves as the ground plane for the microstrip stub 218. In certain examples, a transition from the coaxial cable 210 to the microstrip line 218 may be included on the circuit board 212, as well as other circuitry.

The PCB patch 215 is preferably sized such that radiation to the inside of the vehicle is minimized. Specifically, the PCB patch 215 is preferably sized in relation to a wavelength at which the microwave antenna assembly 200 operates within one or both of the dielectric layers 204, 206. Most preferably, a length and width of the PCB patch 215 are each approximately equal to three fourths of the wavelength (in the second dielectric layer 206) at which the microwave antenna assembly 200 is configured to operate. In one example, the wavelength $\lambda_d$ may be characterized by the following equation:

$$\lambda_d = \frac{c}{f\sqrt{\varepsilon_r}},$$

in which $\lambda_d$ is the wavelength in the glass, c is the speed of light in a vacuum, f is the frequency, and $\in_r$ is the relative permittivity of the glass. With reference to FIG. 6, the length and width of the slot ring 214 are both equal to a first distance 252, and the length and width of the PCB patch 215 are both equal to a second distance 254. In the depicted example (in which the microwave antenna assembly 200 is configured to operate at a frequency of approximately 1.95 GHz), the first distance 252 is equal to approximately thirty-six millimeters, and the second distance 254 is equal to approximately, fifty millimeters. However, these values may vary. In addition, the slot ring 214 has a width equal to a third distance 250. As depicted in FIG. 6, the third distance 250 is equal to approximately three millimeters. However, this may also vary.

The circuit board 212 preferably includes a solder pad 216 with a via hole 217 formed therein. The circuit board 212 preferably comprises a dielectric substrate 213. In one example, the dielectric substrate 213 comprises a material known in the field as FR-4, which is made of woven fiberglass cloth with an epoxy resin binder. However, in other examples, other substrates with suitable dielectric properties may be used.

The coaxial cable 210 is electrically connected to the microstrip line 218 and PCB patch 215. The solder pad 216 and via hole 217 electrically connect the outer conductor of the coaxial cable 210 to the PCB patch 215 of the circuit board 212, and the center conductor of the coaxial cable 210 is connected to the microstrip line 218 by soldering or any other suitable means. As electromagnetic energy is provided into the coaxial cable 210, the coaxial cable 210 transmits the electromagnetic energy to the microstrip line 218. The electromagnetic energy is then transferred to the conductive layer patch 225 via an electromagnetic coupling between the microstrip line 218 and the conductive layer patch 225 through the slot 220. A resonant mode is thereby established between the PCB patch 215 and the conductive layer patch 225, to thereby cause the microwave antenna assembly 200 to radiate in a single direction away from the PCB patch 215 (such as an outer direction away from the interior of the vehicle).

The solder pad 216 is preferably disposed underneath a shield of the coaxial cable 210. The solder pad 216 is preferably part of the circuit board 212. The solder pad 216 and the microstrip are preferably each formed by photolithography.

As indicated above, the ground plane 227 and the coplanar conductive layer patch 225 are integrated into the inner region 205 of the first and second dielectric layers 204, 206 (e.g., the glass of the windshield 71 of the vehicle 12 of FIG. 1). Conversely, the cavity-backing PCB patch 215 comprising slot 220 and microstrip feed (e.g., the microstrip line 218) are externally attached to the bottom of the windshield. Preferably, as shown in the FIGS. 2-5, the PCB patch 215 and the microstrip feed are integrated into the circuit board 212 and adhered to the second dielectric layer 206 (e.g., to the windshield 71 of FIG. 1) using the dielectric adhesive 230 or any other suitable means. In certain examples, the parts may be assembled separately or fabricated by any other means. It should be understood that the circuit board 212 may also contain electronics and or distributed microstrip circuits, and may interface to multiple coaxial cables, power supply wires, and control lines. Furthermore, although a linearly-polarized antenna is shown, this same can be used to achieve dual-polarization or circular polarization, among other possible variations to the microwave antenna assembly 200 of FIG. 2 and/or various parts and/or components thereof.

Figure 7:
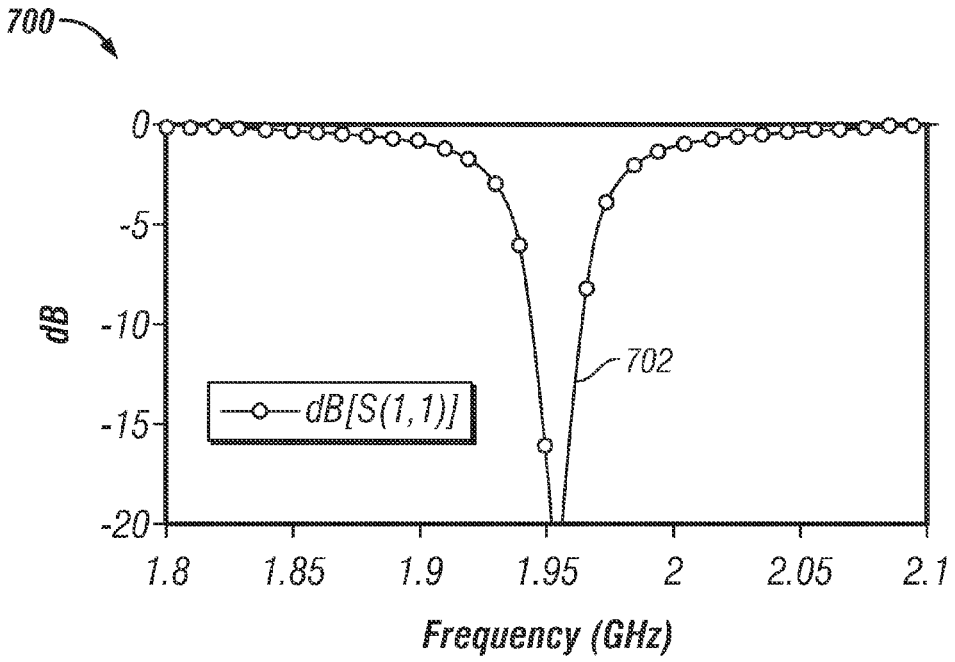
FIG. 7 is a graphical representation, namely, a reflection coefficient plot, further illustrating the effectiveness of the microwave antenna assembly of FIGS. 2-6.

FIG. 7 provides a non-limiting, graphical representation 700 illustrating the effectiveness of the microwave antenna assembly of FIGS. 2-6 using simulated data. The graphical representation 700 includes a reflection coefficient plot 702, with frequency (in GHz) on the x-axis and reflection coefficient magnitude (in dB) on the y-axis. The graphical representation 700 of FIG. 7 illustrates an excellent impedance match at a frequency of approximately 1.95 GHz.

Figure 8:
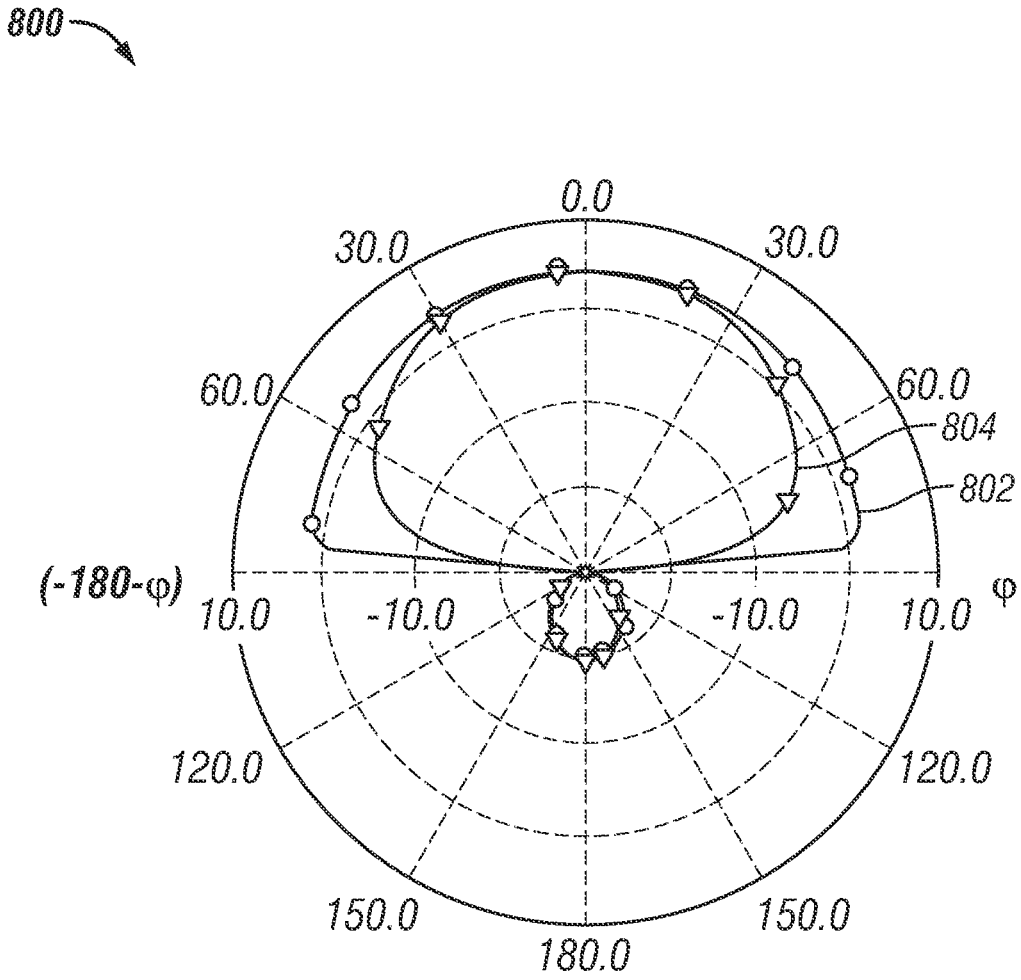
FIG. 8 is another graphical representation, namely, an elevation gain pattern display plot, further illustrating the effectiveness of the microwave antenna assembly of FIGS. 2-6.

FIG. 8 is a non-limiting, graphical representation 800 further illustrating the effectiveness of the microwave antenna assembly of FIGS. 2-6. Graphical representation 800 includes a series of elevation gain pattern display plots for the microwave antenna assembly of FIGS. 2-6 using simulated data. Specifically, FIG. 8 depicts a first elevation gain pattern display plot 802 and a second elevation gain pattern display plot 804 measured at different azimuth angles (namely, zero degrees and ninety degrees, respectively). As shown in FIG. 8, the antenna gain is strong and smooth in the upper region of the plots, indicating that the antenna's radiation is effectively directed outward in a single direction (namely, away from the vehicle rather than toward the inside of the vehicle).

In the exemplary simulation data of FIGS. 7 and 8, the antenna is impedance matched to 50 Ohms from 1.946 to 1.962 GHz. The bandwidth of this exemplary antenna assembly is not known to be optimal, and may be significantly increased in other examples. Furthermore, the front-to-back ratio is greater than 15 dB within a range of frequencies between 1.8 and 2.0 GHz, demonstrating that the microwave antenna assembly 200 of FIGS. 2-6 exhibits effective, single sided radiation over a useful bandwidth of frequencies.

Figure 9:
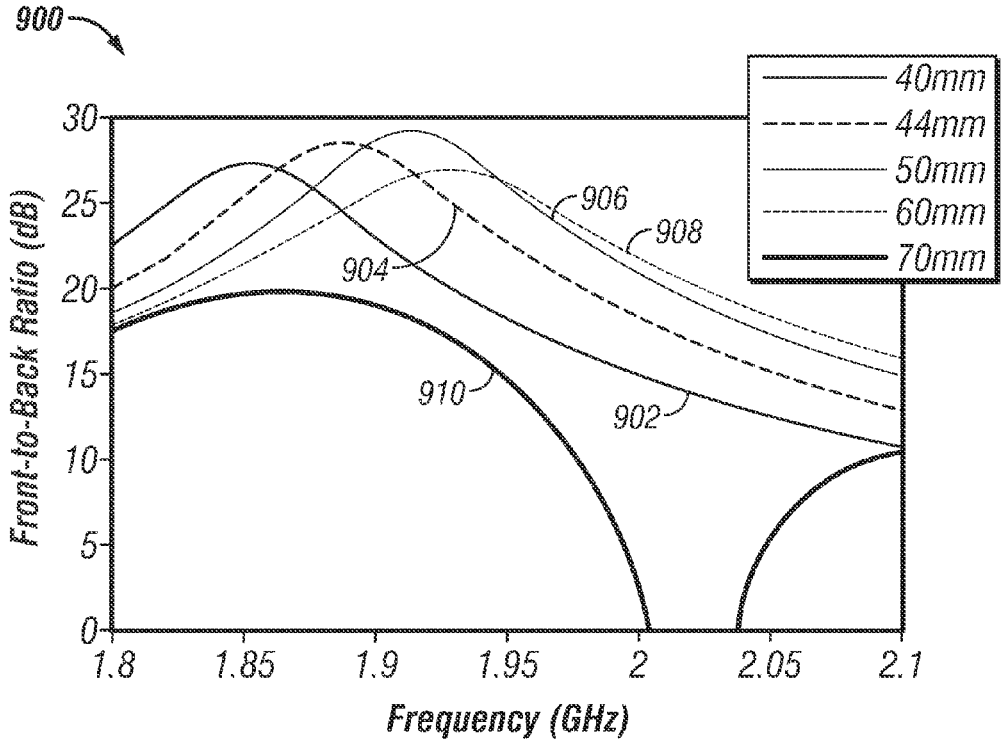
FIG. 9 is another graphical representation, namely, a first series of front-to-back ratio plots, further illustrating the effectiveness of the microwave antenna assembly of FIGS. 2-6.

FIG. 9 is a non-limiting, graphical representation 900 further illustrating the effectiveness of the microwave antenna assembly of FIGS. 2-6. Graphical representation 900 includes a first series of front-to-back ratio plots for the microwave antenna assembly of FIGS. 2-6 using simulated data. The plots each include frequency (in GHz) on the x-axis and a front-to-back ratio (in dB) on the y-axis, where the front-to-back ratio is defined as the ratio of the power radiated to the desired side (for example, outside of the vehicle) to the power radiated to the undesired side (for example, inside the vehicle). In the plots of FIG. 9, the dielectric layers surrounding the conductive layer are assumed to be glass, with a relative permittivity approximately equal to five and thickness approximately equal to 2.25 mm.

In each of these plots, the slot-ring and aperture geometry of FIG. 6 were held constant in size while the size of the PCB patch was varied. The first series of front-to-back ratio plots includes a first plot 902 (in which the PCB patch is 40 mm long/wide), a second plot 904 (in which the PCB patch is 44 mm long/wide), a third plot 906 (in which the PCB patch is 50 mm long/wide), a fourth plot 908 (in which the PCB patch is 60 mm long/wide), and a fifth plot 910 (in which the PCB patch is 70 mm long/wide). As shown in FIG. 9, when the length and width of the PCB patch are equal to 50 mm (which is approximately 0.75 wavelengths in the dielectric layer), the front-to-back ratio is nearly optimal.

Figure 10:
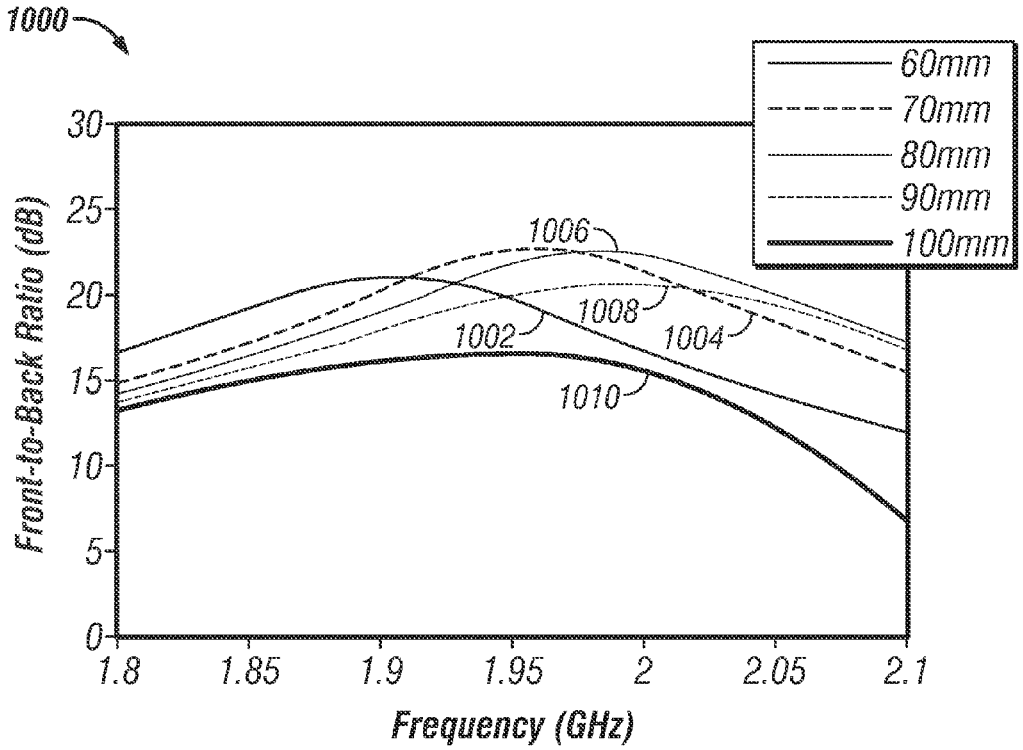
FIG. 10 is another graphical representation, namely, a second series of front-to-back ratio plots, further illustrating the effectiveness of the microwave antenna assembly of FIGS. 2-6.

FIG. 10 is a non-limiting, graphical representation 1000 further illustrating the effectiveness of the microwave antenna assembly of FIGS. 2-6. Graphical representation 1000 includes a second series of front-to-back ratio plots for the microwave antenna assembly of FIGS. 2-6 using simulated data. The second series of front-to-back ratio plots includes a first plot 1002, a second plot 1004, a third plot 1006, a fourth plot 1008, and a fifth plot 1010. Similar to the plots of FIG. 9, the plots of FIG. 10 also include frequency (in GHz) on the x-axis and a front-to-back ratio (in dB) on the y-axis. However, in the plots of FIG. 10, the dielectric layers surrounding the conductive layer are assumed to have a relative permittivity approximately equal to two, instead of five.

In each of the plots of FIG. 10, the slot ring and aperture geometries of FIG. 6 were held constant in size (although increased in size relative to the previous example to account for the longer wavelength) while the size of the PCB patch was varied. Specifically, similar to FIG. 9, in the first plot 1002, the PCB patch is 60 mm long/wide; (ii) in the second plot 1004, the PCB patch is 70 mm long/wide; (iii) in the third plot 1006, the PCB patch is 80 mm long/wide; (iv) in the fourth plot 1008, the PCB patch is 90 mm long/wide; and in the fifth plot 1010, the PCB patch is 100 mm long/wide. As shown in FIG. 10, when the length and width of the PCB patch are equal to 80 mm (which is approximately 0.75 wavelengths in the dielectric layer(s)), the front-to-back ratio is nearly optimal.

Therefore, FIGS. 9 and 10 provide unexpected results indicative of a preferred size of the PCB patch 215 of FIGS. 2-6. Specifically, the simulated results of FIGS. 9 and 10 indicate that the preferred size of the PCB patch 215 for the configuration for the microwave antenna assembly 200 of FIGS. 2-6 is approximately equal to three quarters (i.e. 0.75 multiplied by) the wavelength in the second dielectric layer 206 at which the antenna is configured to operate. This unexpected result holds true among different types of dielectric layers, such as dielectric layers having a relative permittivity equal approximately to five (as in FIG. 9) as well as dielectric layers having smaller relative permittivity (e.g., equal to two, as in FIG. 10).

Accordingly, improved microwave antenna assemblies are provided. The disclosed microwave antenna assemblies provide for improved antenna gain in an outward direction, with decreased radiation in an opposing direction. As used in connection with a preferred example described above, the configuration and sizing of the disclosed antenna assemblies allow for a microwave antenna to be provided within a windshield of the vehicle, with improved antenna gain away from the vehicle and reduced antenna gain directed toward the inside of the vehicle. Consequently, the disclosed microwave antenna assemblies can help to decrease interference and noise, for example from the vehicle in which the microwave antenna assemblies may be utilized. Furthermore, the antenna assemblies can be installed without requiring any holes in the vehicle windshield or other dielectric material composing the dielectric layer 206.

It will be appreciated that the disclosed systems and components thereof may differ from those depicted in the figures and/or described above. For example, the communication system 10, the telematics unit 24, and/or various parts and/or components thereof may differ from those of FIG. 1 and/or described above. Similarly, the microwave antenna assembly 200 and/or various parts or components thereof may differ from those of FIGS. 2-6 and/or described above, and/or the simulation results may differ from those depicted in FIGS. 7-10.

Similarly, it will similarly be appreciated that, while the disclosed systems are described above as being used in connection with automobiles such as sedans, trucks, vans, and sports utility vehicles, the disclosed systems may also be used in connection with any number of different types of vehicles, and in connection with any number of different systems thereof and environments pertaining thereto.

While at least one example has been presented in the foregoing detailed description, it should be appreciated that a vast number of variations exist. It should also be appreciated that the detailed description represents only examples, and is not intended to limit the scope, applicability, or configuration of the invention in any way. Rather, the foregoing detailed description will provide those skilled in the art with a convenient road map for implementing the examples. It should be understood that various changes can be made in the function and arrangement of elements without departing from the scope of the invention as set forth in the appended claims and the legal equivalents thereof.

What is claimed is:

1. A microwave antenna assembly comprising:

a first dielectric layer;

a second dielectric layer, wherein the first and second dielectric layers form an inner region therebetween;

a conductive layer disposed in the inner region between the first dielectric layer and the second dielectric layer, the conductive layer including a slot;

a first conductive patch surrounded by the slot; and a second conductive patch disposed against the second dielectric layer outside the inner region and electromagnetically coupled to the first conductive patch;

wherein the microwave antenna assembly is configured to operate at a wavelength within the second dielectric layer, and the second conductive patch has a length that is approximately equal to three fourths of the wavelength.

2. The microwave antenna assembly of claim 1, further comprising:

a dielectric adhesive attaching the second conductive patch to the second dielectric layer.

3. The microwave antenna assembly of claim 1, wherein:

the first and second dielectric layers each comprise glass; and the conductive layer comprises a substantially transparent material.

4. The microwave antenna assembly of claim 1, wherein the conductive layer is greater than the first conductive patch in size.

5. The microwave antenna assembly of claim 1, wherein:

the first conductive patch has a first length and a first width; and the second conductive patch has a second length and a second width, the second length being greater than the first length, and the second width being greater than the first width.

6. The microwave antenna assembly of claim 1, wherein the second conductive patch is part of a circuit board.

7. The microwave antenna assembly of claim 6, wherein the circuit board further includes a slot formed within the second conductive patch.

8. The microwave antenna assembly of claim 1, further comprising:

a coaxial cable coupled to the second conductive patch.

9. A microwave antenna assembly comprising:

a first glass layer;

a second glass layer;

a transparent conductive layer disposed between the first and second glass layers, the transparent conductive layer including a slot;

a conductive patch surrounded by the slot; and a circuit board disposed against the second glass layer, wherein the second glass layer is disposed between the conductive patch and the circuit board and the circuit board is electromagnetically coupled to the conductive patch;

wherein the microwave antenna assembly is configured to operate at a wavelength within the second glass layer, and the second conductive patch has a length that is approximately equal to three fourths of the wavelength.

10. The microwave antenna assembly of claim 9, wherein the conductive layer is greater than the conductive patch in size.

11. The microwave antenna assembly of claim 9, further comprising:

a dielectric adhesive attaching the circuit board to the second glass layer.

12. The microwave antenna assembly of claim 9, wherein the circuit board comprises:

a second conductive patch that is electromagnetically coupled to the conductive patch; and a slot formed within the second conductive patch.

13. The microwave antenna assembly of claim 12, wherein:

the conductive patch has a first length and a first width; and the second conductive patch has a second length and a second width, the second length being greater than the first length, and the second width being greater than the first width.

14. The microwave antenna assembly of claim 12, further comprising:

a coaxial cable coupled to the second conductive patch.

15. A microwave antenna assembly for a vehicle, the microwave antenna assembly comprising:

a windshield of the vehicle;

a transparent conductive layer disposed within the windshield, the transparent conductive layer including a slot;

a first conductive patch surrounded by the slot and having a first length and a first width; and a circuit board attached against the windshield via a dielectric adhesive, the circuit board comprising a second conductive patch that is electromagnetically coupled to the first conductive patch;

wherein the microwave antenna assembly is configured to operate at a wavelength within the windshield, and the second conductive patch has a length that is approximately equal to three fourths of the wavelength.

16. The microwave antenna assembly of claim 15, wherein the circuit board further comprises a slot formed within the second conductive patch.

17. The microwave antenna assembly of claim 15, further comprising:

a coaxial cable coupled to the second conductive patch.

* * * * *